United States Patent [19]

Kraft

[11] 4,404,935

[45] Sep. 20, 1983

[54] CERAMIC CAPPED PISTON

[75] Inventor: Edwin H. Kraft, San Diego, Calif.

[73] Assignee: Kyocera International, Inc., San Diego, Calif.

[21] Appl. No.: 257,666

[22] Filed: Apr. 27, 1981

[51] Int. Cl.[3] ..... F01B 31/08

[52] U.S. Cl. ..... 123/193 P; 92/215; 92/224; 92/248; 123/669

[58] Field of Search ..... 123/193 R, 193 P, 668, 123/669; 92/187, 212, 215, 224, 248

[56] References Cited

U.S. PATENT DOCUMENTS

| | | | |
|---|---|---|---|
| 3,855,986 | 12/1974 | Wiss | 123/668 |
| 3,983,793 | 10/1976 | Beardmore | 92/212 |
| 4,242,948 | 1/1981 | Stang et al. | 123/193 P |

FOREIGN PATENT DOCUMENTS

| | | | |
|---|---|---|---|
| 147036 | 6/1952 | Australia | 123/669 |
| 731632 | 2/1943 | Fed. Rep. of Germany | 92/224 |
| 522113 | 6/1940 | United Kingdom | 123/193 P |
| 1338712 | 11/1973 | United Kingdom | 123/668 |

*Primary Examiner*—Craig R. Feinberg

*Attorney, Agent, or Firm*—Spensley, Horn, Jubas & Lubitz

[57] ABSTRACT

A ceramic cap is attached to a metal piston by means of intermeshing radial flanges. A spring forces the flanges into contact with one another along an annular surface area. Spaces between the flanges allow for movement between the metal and ceramic parts to accommodate differential thermal expansion, while at the same time permitting secure contact between metal and ceramic.

3 Claims, 5 Drawing Figures

CERAMIC CAPPED PISTON

BACKGROUND OF THE INVENTION

1. Field of the Invention

The present invention relates to a piston assembly for use in an internal or external combustion engine. More specifically, the present invention relates to a piston assembly having a metallic body and ceramic cap.

2. Description of the Prior Art

In some combustion engines it is desirable to use pistons having a cap portion composed of ceramic and a body or skirt portion composed of metal. Pistons of this type have several advantages over pistons composed entirely of metal, with the major advantage being that they permit operation at elevated temperatures.

An example of a type of engine which can benefit from the use of a ceramic piston cap is a supercharged engine. The output of some engines can be greatly increased through the use of a supercharger. However, such engines stress conventional pistons to their design limit due to increased combustion pressure and a consequent heat build-up in the piston. In extreme cases this heat build-up results in a deformed or cracked piston skirt. Such deformation and cracking can be prevented by means of a ceramic cap placed at the head of the piston to insulate the piston skirt from the extreme heat generated in the engine chamber. Because such a ceramic cap insulates the piston skirt from much of this heat, the metallic piston skirt operates at a lower temperature than would be the case if it were integral with a metallic piston head. The lower skirt temperature permits closer tolerances between the piston skirt and the engine chamber, thereby reducing noise generated by the piston during operation.

One method of attaching a ceramic piston cap to a metallic piston body is by means of bolts as illustrated in prior art FIG. 1. This method of attachment causes heat loss from the ceramic cap to the metallic body via the bolts, as well as increased pressure sensitivity at the bolt/cap interface. This method eventually results in bolt failure due to melting, corrosion or mechanical failure of the bolts at the elevated temperature allowed by use of the ceramic cap, as well as cracking of the ceramic cap due to stress concentration at the bolt heads. A second method of attachment is by means of a cap extension which is secured directly to the piston pin, as illustrated in prior art FIG. 2. This method requires a fixed amount of space between the cap extension and the pin to allow for the different rates of thermal expansion between metal and ceramic. Such a space produces excessive movement between the ceramic and metallic pieces, thereby increasing unwanted noise produced by the piston in operation. Moreover, tensile stress induced by differential thermal expansion of the cap extension and piston pin during piston operation leads to mechanical failure of the cap extension. Devices using similar connection methods, but not employing ceramic caps, are shown in U.S. Pat. Nos. 2,310,907 to Hall and 4,013,057 to Guenther, respectively.

Other methods of attachment include casting the cap into a preformed metallic skirt (U.S. Pat. No. 2,473,254), or securing the cap to the skirt by means of matching grooves (U.S. Pat. Nos. 2,257,236; 1,969,470; 1,743,323) or threads (U.S. Pat. No. 1,357,851). Each of these methods ultimately results in mechanical failure of the ceramic cap due to the pressure sensitivity of brittle ceramic and the thermal expansion differential between ceramic and metal.

An objective of the present invention is to provide a ceramic capped piston capable of operation in high output engines. Another objective of the present invention is to allow sufficient space for differential thermal expansion between the ceramic cap and the metallic body of a ceramic capped piston, while at the same time preventing excessive movement between the ceramic and metallic pieces. A further objective of the present invention is to distribute stresses between the ceramic and metallic pieces of a ceramic capped piston sufficiently to prevent mechanical failure of the ceramic during operation.

SUMMARY OF THE INVENTION

In accordance with the present invention, these and other objectives are achieved by providing a ceramic piston cap having an outwardly extending radial flange along its lower surface. This flange intermeshes with an inwardly extending radial flange formed by two semicircular metallic members enclosed within a tubular metallic skirt. The two flanges are forced into secure contact with one another by a spring which rests upon a circumferential horizontal ledge formed by the semicircular metallic members. Stress between the metallic and ceramic parts is evenly distributed along the annular contact surface formed between the two flanges. Movement caused by differential thermal expansion between the metallic and ceramic parts is permitted by spaces between the two flanges.

BRIEF DESCRIPTION OF THE DRAWINGS

The detailed description of the invention will be made with reference to the accompanying drawings, wherein like numerals designate corresponding parts in the several figures.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention best is defined by the appended claims.

Figure 1:
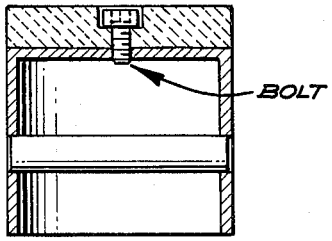
FIG. 1. PRIOR ART
FIG. 1 is a cross-sectional view of a piston according to the prior art method of attaching a ceramic piston cap to a metallic piston body by means of bolts.
Figure 2:
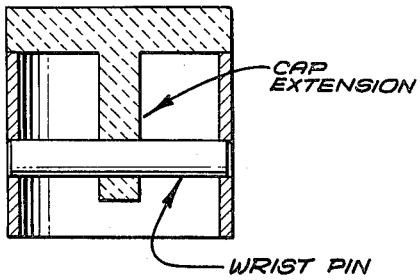
FIG. 2. PRIOR ART
FIG. 2 is a cross-sectional view of a piston according to the prior art method of attaching a ceramic piston cap to a metallic piston body by means of a cap extension secured directly to the piston pin.
Figure 3:
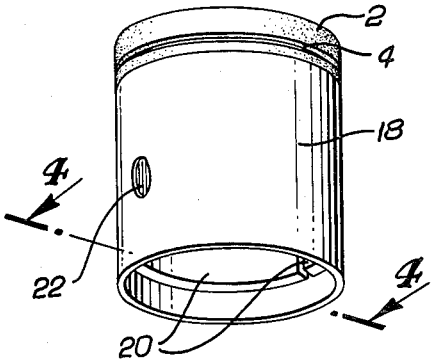
FIG. 3 is a perspective view of a piston according to the present invention.
Figure 4:
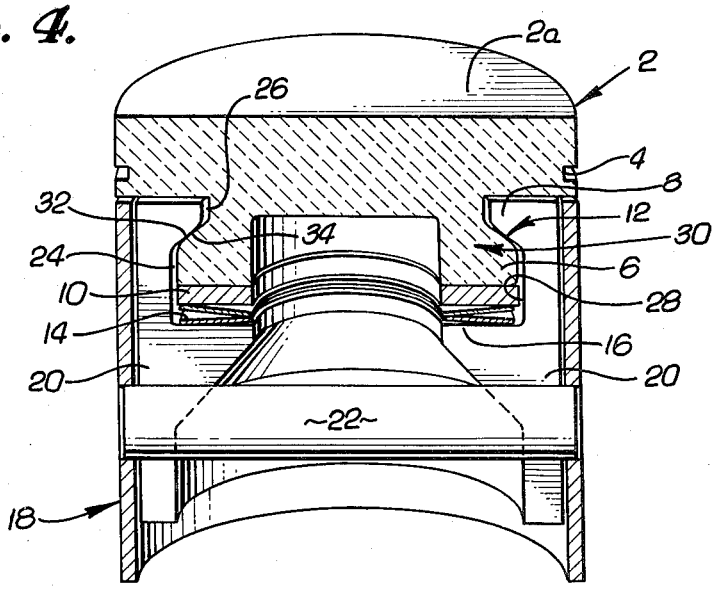
FIG. 4 is a perspective sectional view of the piston of FIG. 3 taken along lines 4—4.

Referring to FIGS. 3 and 4, the piston assembly of the present invention includes a ceramic piston cap 2 secured to a cylindrical metallic skirt portion 18. The ceramic cap, which may be made of a ceramic such as silicon nitride Zirconia, or silicon carbide, may or may not include a circumferential groove 4 which serves to retain a piston ring (not shown). In operation, the piston assembly reciprocates within a cylinder, with the top surface 2*a* of the piston cap 2 being exposed to the combustion which occurs within the chamber. The use of ceramic material for the piston cap enables higher temperatures to be achieved than would be the case if the piston were made entirely of metallic material. It should be noted that although the top surface 2*a* is shown as being flat, it could have a bowl-like or other surface configuration, depending upon the particular application.

The skirt portion 18 is a tubular element which serves to retain a pair of identical semicircular (see FIG. 4) metallic body elements 20 in position. In the preferred embodiment of the invention the body elements 20 and skirt 18 are aligned with respect to one another by means of a wrist pin 22, which in turn is connected to a piston rod (not shown), although it is understood that body elements 20 and skirt 18 may be aligned by means of pins, bolts or other methods. Alternatively, body elements 20 may be retained by means of pins, bolts, or other means without a separate skirt 18.

Due to the heat generated in the combustion chamber during operation, both the ceramic and metallic elements of the piston will expand. Because the ceramic piston cap and metallic body and skirt portions have different rates of thermal expansion, the piston assembly must be designed to accommodate relative movement between these elements. This is accomplished by means of an intermeshing flange assembly as shown in FIG. 4. The piston cap includes a downwardly extending circular element 30 having an outwardly extending flange portion 6. The flange portion 6 includes a circumferential bearing surface 34 which faces the upper surface 2*a* of the piston cap. It should be noted that although surface 34 is shown as being flat, it could have a slight outward bulge which would serve to define a convex bearing surface. The body members 20 together define a central circular opening 28 into which the extension 30 fits. A horizontal extension 8 extends inwardly from the top of the body members 20 so as to define a circumferential bearing surface 32 on the lower surface thereof. As is the case with the surface 34, surface 32 is shown as being flat, although surface 32 could also be bowed outwardly so as to define a convex bearing surface. The surface 32 faces away from the top surface of the piston cap and is contacted by the circumferential bearing surface 34 of the cap. The extension of both the ceramic cap and metallic body members resemble dovetail flanges. The extensions 6 and 8 are designed so that they are short enough to provide spaces 24 and 26 between them and the body member and cap, respectively. The design thus provides for contact between the cylinder cap and body members only along a narrow annular area 12 while still providing a substantial amount of open space to accommodate differential thermal expansion between the body members and cap.

If any differential thermal expansion occurs, the annular contact area 12 will maintain a substantially constant size because of the surfaces 34 and 32, and the cylinder cap and body member portions will simply expand into the open spaces 24 and 26. Because annular contact area 12 forms an essentially continuous surface of contact between the cylindrical cap and body members, the pressure transfer area between the ceramic and metallic elements of the piston is maximized, thereby preventing mechanical failure of the ceramic during operation.

In order to force the surfaces 34 and 32 into contact with one another, some sort of bias means must be provided to urge the cylinder cap 2 away from the body member 20. In the embodiment shown in FIG. 4, this is accomplished by means of a spring 14 and washer 10. The body members 20 include a circumferential horizontal ledge portion 16 upon which the spring 14 rests. The spring 14, which may be of a type such as a belleville washer, forces the washer 10 against the bottom surface of the cap extension 30, thus biasing the surfaces 34 and 32 together. Of course, many other biasing mechanisms could be employed.

During engine operation, heat generated in the engine combustion chamber will cause the ceramic piston cap 2 and body members 20 to expand. Horizontal expansion of these elements is facilitated by open spaces 24 and 26, while differential vertical expansion of these elements is facilitated by spring 14. The spring 14 serves to force surface 34 of ceramic piston cap 2 upward into contact with surface 32 of body members 20. Thus, while some sliding will occur along annular contact area 12 due to the differential thermal expansion between the metal and ceramic parts, firm contact between the piston cap 2 and body members 20 will be maintained throughout operation of the engine.

Figure 5:
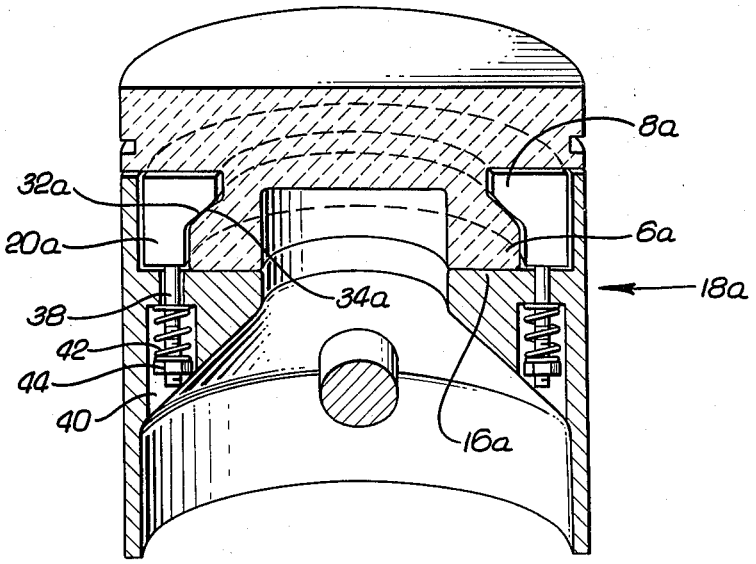
FIG. 5 is a perspective sectional view of a piston according to an alternative embodiment of the present invention.

An alternative embodiment of the present invention is shown in FIG. 5. Circumferential horizontal ledge portion 16*a* is integral with cylindrical metallic skirt portion 18*a*. A flange 8*a* extends from a pair of identical semicircular body elements 20*a*. Attached to each body element 20*a* are two or three vertical pins 38 which fit into recesses 40 of ledge portion 16*a*. The vertical pins 38 are surrounded by springs 42, which are retained in recesses 40 by nuts 44. Springs 42 thereby force extension 8*a* against flange 6*a*, thus biasing surfaces 34*a* and 32*a* together.

Vertical expansion, during engine operation, of extension 8*a* and flange 6*a* is permitted by spring 42, which also serves to force surface 32*a* into contact with surface 34*a*. Firm contact between the ceramic piston cap and metallic piston body is thereby maintained throughout engine operation.

In summary, the present invention provides a piston assembly in which secure contact between a piston cap and body member is maintained while at the same time allowing for differential thermal expansion between the ceramic cap and metallic body member.

What is claimed is:

1. A piston assembly comprising:

(a) a ceramic piston cap including:

a cylindrical cap section having upper and lower surfaces, a downward facing extension attached to the lower surface of the cap section, and an outwardly extending first radial flange attached to the extension and spaced from the lower surface of the cap section, said flange including a first contact surface which faces toward the cap section;

(b) a metallic body including:

a cylindrical body section having an upper surface with a central opening therein defined by a wall portion and a lower platform, a second radial flange extending inwardly into said central opening from the wall portion, said second flange extending into the space between the first flange and the lower surface of the cap section and including a second contact surface which faces away from the cap section; and (c) bias means for forcing the first contact surface against the second contact surface;

wherein the first and second flanges are configured so that contact between said flanges is limited to said first and second contact surfaces, whereby the assembly can accommodate differential thermal expansion of the piston cap and body while maintaining continuous contact therebetween;

wherein said bias means is a spring located between said lower platform and said downward facing cap extension, wherein said spring forces said cap away from said body.

2. The piston assembly of claim 1 wherein said spring is a belleville washer.

3. The piston assembly of claim 1 or 2 wherein said bias means includes a washer in communication with said spring.

* * * * *